US006547993B1

(12) United States Patent
Joshi

(10) Patent No.: US 6,547,993 B1
(45) Date of Patent: Apr. 15, 2003

(54) PROCESS FOR MAKING POLYTETRAFLUOROETHYLENE-ALUMINUM COMPOSITE AND PRODUCT MADE

(75) Inventor: Vasant S. Joshi, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 205 days.

(21) Appl. No.: 09/853,928

(22) Filed: May 9, 2001

(51) Int. Cl.[7] ..... C06B 21/00; C06B 27/00
(52) U.S. Cl. ..... 264/3.4; 149/19.3
(58) Field of Search ..... 264/3.4; 149/19.3, 149/19.92

(56) References Cited

U.S. PATENT DOCUMENTS 3,274,894 A * 6/1981 McNeely et al. ..... 149/7
H169 H 12/1986 Mackenzie et al. ..... 149/19.3
5,180,759 A 1/1993 Neu et al. ..... 523/141
5,472,533 A 12/1995 Herbage et al. ..... 149/22
5,627,339 A 5/1997 Brown et al. ..... 149/19.3
5,717,159 A * 2/1998 Dixon et al. ..... 149/40
5,886,293 A 3/1999 Nauflett et al. ..... 149/109.6

FOREIGN PATENT DOCUMENTS

JP 49-94506 * 9/1974

* cited by examiner

*Primary Examiner*—John Hardee
(74) *Attorney, Agent, or Firm*—Mark Homer

(57) ABSTRACT

A process for making a Teflon/aluminum composite includes providing Teflon powder and aluminum powder wherein a size of Teflon particles is about 7 to 12 times a size of aluminum particles; mixing the Teflon powder with the aluminum powder on about a 3 to 1 weight basis; pressing the mixed powder into a shape at a pressure ranging from about 6000 psi to about 16000 psi; and then sintering the pressed shape.

17 Claims, 1 Drawing Sheet

PROCESS FOR MAKING POLYTETRAFLUOROETHYLENE-ALUMINUM COMPOSITE AND PRODUCT MADE

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to reactive materials, and, in particular, to reactive materials for use in munitions such as warheads and the like.

Many types of materials are used in warheads to create an exothermic reaction upon impact or in the vicinity of the desired target. Explosives are one class of materials used in such warheads. Some materials are not technically explosives, but are nonetheless reactive. These reactive materials are desirable because of their stability during manufacture, during launch of the warhead and during delivery of the warhead to the target.

One problem with such reactive materials is that they may fragment before reaching their intended target, thereby greatly reducing their effectiveness in producing the desired level of exothermic reaction. Thus, a need exists for a reactive material having sufficient strength to withstand launch and delivery stresses without breaking up.

The present invention is directed to a process for making a polytetrafluoroethylene-aluminum (PTFE-Al) composite material having increased strength, and the material made by the process.

Further objects, features, and advantages of the invention will become apparent from the following detailed description of the preferred embodiments, taken in conjunction with the accompanying drawing.

DETAILED DESCRIPTION OF THE PREFERRED EMBODIMENTS

Figure 1:
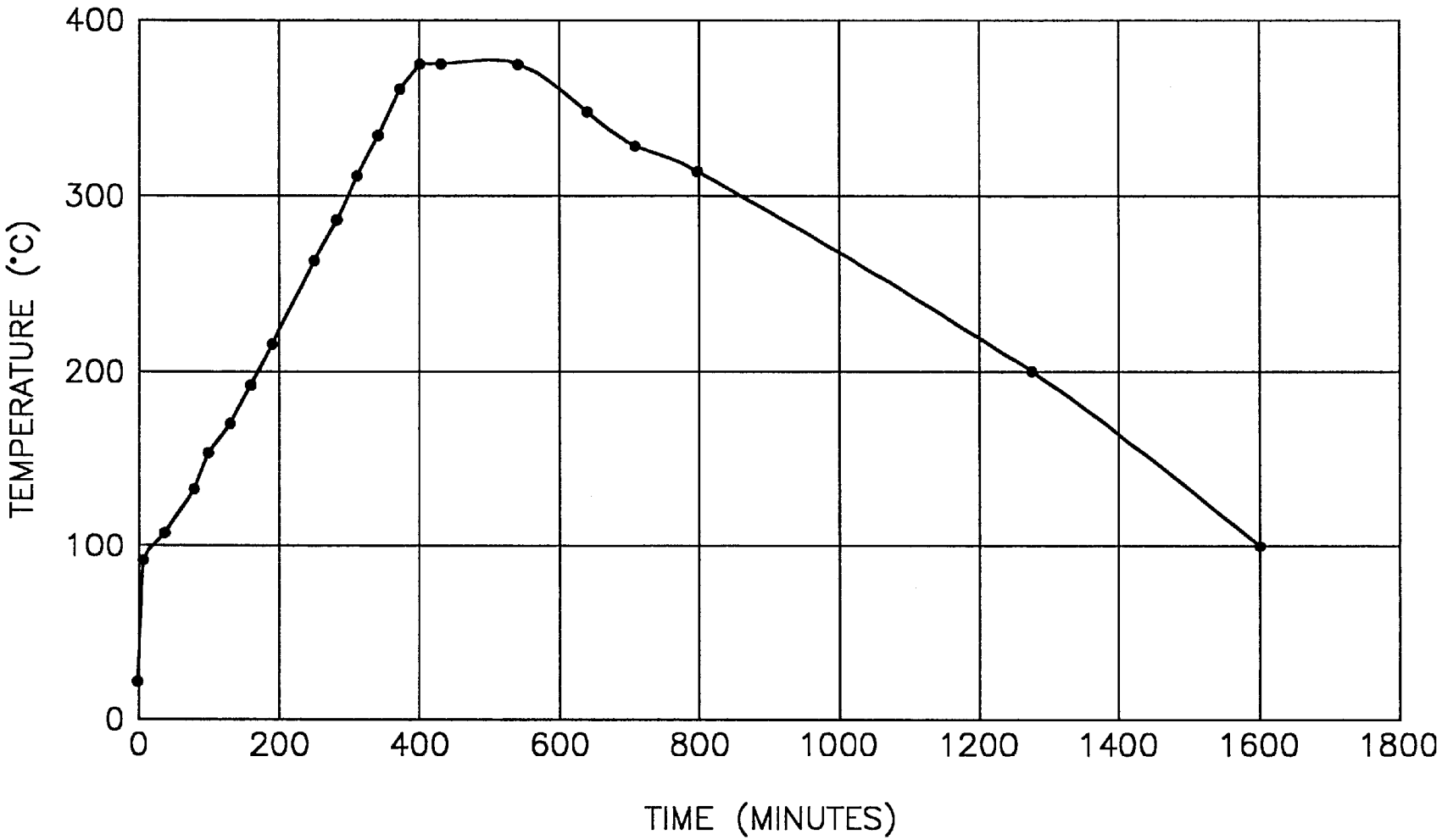
FIG. 1 shows a sintering cycle in accordance with the invention.

The inventive process is used to make a high strength PTFE-Al composite material. The process involves intimate, dry mixing of PTFE (Teflon) powder and aluminum powder in a certain proportion. The mixed powder is then pressed and sintered under specific conditions, to form a desired shape. The material thus produced is fairly stable at room temperature, but capable of violently and fully reacting to produce a large amount of heat upon impact or ignition.

The inventive process uses Teflon powder and aluminum powder. The size of the Teflon particles should be about 7 to 12 times the size of the aluminum particles. Preferably, Teflon 7A (average 35 micron particle size, made by Du Pont) and aluminum powder H-5 (average 5 micron particle size) are used. These fine powders allow intimate mixing due to a good size match between the aluminum and Teflon particles. The weight ratio of Teflon to aluminum is about 3:1. The preferred weight ratio is 73.5% Teflon and 26.5% aluminum.

Coarse, spherical powders are free flowing and pose less problems in mixing. Since finer Teflon powder has a tendency to form lumps, non-stoichiometric or non-homogenous mixtures are hard to eliminate. Vibratory mixing or slow tumble mixing, followed by sieving to remove agglomerates, results in preferential removal of Teflon. Mixing in high shear mixers eliminates the problems associated with such powder combinations.

Dry mixing is preferred over wet mixing for various reasons. Contamination from wet media can be trapped in the mix, resulting in reduced contact area between aluminum and Teflon. Successful removal of minute traces of wet media is difficult. Any condition that introduces additional material in the composite eventually affects its desired properties.

A variety of high shear mixers can be used to achieve a good mix. These include tumble mixers with high-shear intensifiers and counter rotating fluidizing mixers. No sieving of the material should be required for a well mixed material.

Preferably, mixing is done using a high shear mixer with a simultaneous tumbling action. The mixing results in the breakup of any lumps. The shearing action of the mixing blade results in impacting of the Teflon and aluminum particles thereby resulting in intimate contact between the powders. Depending on the amount of material being mixed, the powders should be mixed for about 20 to 30 minutes. No sieving of the material is required.

After the mixture is made, the material is pressed in a die to make a specific shape. The pressure applied to the mixture in the die is between about 6000 psi to 16000 psi. A preferred range is 8,000–14,000 psi. A more preferred range is 10,000–12,000 psi. A dwell time of about 10 to 20 minutes is sufficient, depending on the size of the sample.

After pressing, the pressed shape undergoes a sintering cycle. The sintering cycle obtains cross-linking of the polymeric material. Sintering allows the particles to fuse together to form a homogeneous material. The sintering cycle is dependent on the geometry and the dimension aspect ratio of the pressed shape. For an optimum level of sintering, the heating and cooling cycle should be tailored for individual use, depending on the available capability of the furnace.

Because of the possible hazards of reaction or ignition during sintering, sintering is performed under an inert media, for example, an argon atmosphere, to prevent any oxidation or surface reaction. The sintering cycle includes heating the pressed sample at a rate of about 50 degrees C. per hour to a final temperature in the range of 375–385 degrees C., holding at the final temperature for 2–6 hours and then cooling to room temperature. Preferably, the sample is first slow cooled (0.75 degrees C. to 0.25 degrees C. per minute) to below the freezing temperature of Teflon (about 325 degrees C.) and then fast cooled (up to about 2 degrees C. per minute) to room temperature.

Samples made using the inventive process showed a tensile strength increase of over 400% and an elongation increase of over 300% compared to unsintered composite samples.

EXAMPLE

Teflon 7A (average 35 micron particle size, made by Du Pont) and aluminum powder H-5 (average 5 micron particle size) were mixed in a weight ratio of 73.5% Teflon and 26.5% aluminum. The powders were dry mixed for 20 minutes using a high shear mixer with a simultaneous tumbling action. The mixture was pressed in a die at 10,000 psi for 10 minutes. The pressed shape underwent the sintering cycle shown in FIG. 1. Tensile specimens made from the sintered shape showed significant increases in both tensile strength and elongation.

Although the process has been described using an aluminum powder, other materials such as lithium, magnesium and titanium alloys could be used to make a similar reactive composite. In the case of intermetallic compositions (nickel/aluminum, nickel/titanium, etc.), the weight proportion of Teflon may be lowered.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A process, comprising:

providing polytetrafluoroethylene powder and aluminum powder wherein a size of Teflon particles is about 7 to 12 times a size of aluminum particles;

mixing the polytetrafluoroethylene powder with the aluminum powder on about a 3 to 1 weight basis;

pressing the mixed powder into a shape at a pressure ranging from about 6000 psi to about 16000 psi; and then sintering the pressed shape.

2. The process of claim 1 wherein the size of the polytetrafluoroethylene particles is about 35 microns and the size of the aluminum particles is about 5 microns.

3. The process of claim 1 wherein the mixing step includes mixing, on a weight basis, 73.5% polytetrafluoroethleyne with 26.5% aluminum.

4. The process of claim 1 wherein the mixing step includes dry mixing using a high shear mixer with a simultaneous tumbling action.

5. The process of claim 4 wherein the mixing step includes mixing for about 20 to 30 minutes.

6. The process of claim 1 wherein the pressing step includes pressing at 10,000 psi.

7. The process of claim 6 wherein the pressing step includes pressing for about 10 to 20 minutes.

8. The process of claim 1 wherein the sintering step includes heating the pressed sample at a rate of about 50 degrees C. per hour to a final temperature in the range of 375–385 degrees C., holding at the final temperature for 2–6 hours and then cooling to room temperature.

9. The process of claim 1 wherein the sintering step is performed in the presence of an inert media.

10. A process, comprising:

providing polytetrafluoroethylene powder and aluminum powder wherein a size of Teflon particles is about 35 microns and a size of aluminum particles is about 5 microns;

mixing the polytetrafluoroethylene powder and the aluminum powder on a weight basis of 73.5% Teflon and 26.5% aluminum;

pressing the mixed powder into a shape at a pressure of 10,000 psi; and then sintering the pressed shape.

11. The process of claim 10 wherein the mixing step includes dry mixing using a high shear mixer with a simultaneous tumbling action.

12. The process of claim 11 wherein the mixing step includes mixing for about 20 minutes.

13. The process of claim 12 wherein the pressing step includes pressing for about 10 minutes.

14. The process of claim 13 wherein the sintering step includes heating the pressed sample at a rate of about 50 degrees C. per hour to a final temperature in the range of 375–385 degrees C., holding at the final temperature for 2–6 hours, slow cooling to about 325 degrees C. and then fast cooling to room temperature.

15. The process of claim 14 wherein the sintering step is performed in the presence of an inert media.

16. A product made by the process of claim 1.

17. A product made by the process of claim 15.

* * * * *